US010506836B2

(12) United States Patent
Takagi et al.

(10) Patent No.: US 10,506,836 B2
(45) Date of Patent: Dec. 17, 2019

(54) GLOVE

(71) Applicant: SHOWA GLOVE CO., Himeji-shi, Hyogo (JP)

(72) Inventors: Ryo Takagi, Hyogo (JP); Mako Toyokuni, Hyogo (JP)

(73) Assignee: Showa Glove Co., Hyogo (JP)

( * ) Notice: Subject to any disclaimer, the term of this patent is extended or adjusted under 35 U.S.C. 154(b) by 390 days.

(21) Appl. No.: 15/375,327

(22) Filed: Dec. 12, 2016

(65) Prior Publication Data

US 2017/0280795 A1 Oct. 5, 2017

(30) Foreign Application Priority Data

Apr. 1, 2016 (JP) ..... 2016-074461

(51) Int. Cl.

*A41D 19/015* (2006.01)
*A41D 13/015* (2006.01)
*A41D 31/28* (2019.01)
*A41D 31/30* (2019.01)

(52) U.S. Cl.

CPC ... *A41D 19/01523* (2013.01); *A41D 13/0156* (2013.01); *A41D 19/01505* (2013.01); *A41D 31/285* (2019.02); *A41D 31/30* (2019.02)

(58) Field of Classification Search

CPC ..... A41D 13/0156; A41D 19/01523; A41D 31/285; A41D 31/30
USPC ..... 2/16
See application file for complete search history.

(56) References Cited

U.S. PATENT DOCUMENTS 3,882,548 A 5/1975 Shinagawa et al.
4,570,269 A 2/1986 Berlese
5,686,147 A * 11/1997 Ngoc ..... C08L 27/06 427/375
D608,978 S * 2/2010 Votel ..... D2/617
(Continued)

FOREIGN PATENT DOCUMENTS

CN 203986254 U 12/2014
CN 105411052 A 3/2016
(Continued)

OTHER PUBLICATIONS

Search Report dated Jul. 31, 2017, issued in counterpart European Application No. 16203648.7 (9 pages).

*Primary Examiner* — Anne M Kozak
(74) *Attorney, Agent, or Firm* — Norris McLaughlin, P.A.

(57) ABSTRACT

A glove is provided that is superior in impact resistance and allows prevention of dislocation and detachment of an impact-resistant pad. The glove includes: a stretchable glove main body made of fiber; a coating layer comprising a synthetic resin or rubber as a principal component, being laminated to an external face of the glove main body at least in a finger portion and a palm portion; and impact-resistant pads comprising a synthetic resin as a principal component, being provided to at least a part of an external face side of the coating layer on a back hand side of the glove main body, in which the impact-resistant pad is sewn onto the glove main body. The glove main body is preferably seamless. The impact-resistant pad is preferably provided to the finger portion. An internal face of the impact-resistant pad and an external face of the coating layer are preferably smooth.

3 Claims, 5 Drawing Sheets

(56) References Cited

U.S. PATENT DOCUMENTS

| | | | | |
|---|---|---|---|---|
| 8,028,347 | B2 * | 10/2011 | Chang | A41D 19/01588 2/161.1 |
| 8,479,318 | B2 * | 7/2013 | Kim | A41D 19/01588 2/161.1 |
| 8,490,217 | B2 * | 7/2013 | Safford | A41D 19/015 2/161.6 |
| 2010/0071114 | A1 | 3/2010 | Jaeger | |
| 2012/0159681 | A1 | 6/2012 | Gibby | |
| 2014/0033392 | A1 * | 2/2014 | Bulan | A41D 19/01529 2/16 |
| 2015/0128324 | A1 * | 5/2015 | Baker | A41D 19/0006 2/20 |
| 2016/0120242 | A1 * | 5/2016 | Thompson | A41D 19/001 2/161.6 |
| 2016/0192721 | A1 * | 7/2016 | Kishihara | A41D 19/01558 2/159 |
| 2016/0367882 | A1 * | 12/2016 | Ramirez | A41D 19/01564 |
| 2017/0295869 | A1 * | 10/2017 | Choi | A41D 19/0006 |

FOREIGN PATENT DOCUMENTS

| | | | |
|---|---|---|---|
| FR | 2 245 308 | A1 | 4/1975 |
| JP | S62-136521 | U | 8/1987 |
| JP | H4-89510 | U | 8/1992 |
| JP | 2005-325456 | A | 11/2005 |
| JP | 2006-225782 | A | 8/2006 |
| JP | 2008-537025 | A | 9/2008 |

* cited by examiner

GLOVE

BACKGROUND OF THE INVENTION

Field of Invention

The present invention relates to a glove.

Description of the Related Art

As a glove to be used in labor such as civil engineering and construction works, a glove with a high-strength protection portion (impact-resistant pad) provided to an outer side thereof has been known (refer to Japanese Unexamined Patent Application, Publication No. 2005-325456).

In the glove disclosed in the above-cited publication, a protection portion formed from a resin or the like is fixed by adhesion to a stretchable fiber material of a glove main body. However, in the glove in which the protection portion is adhered to the stretchable fiber, the protection portion may separate as the glove main body stretches, and may thus be dislocated and detached.

PRIOR ART DOCUMENTS

Patent Documents

Patent Document 1: Japanese Unexamined Patent Application Publication No. 2005-325456

SUMMARY OF THE INVENTION

The present invention has been made in view of such circumstances and is aimed at providing a glove that is superior in impact resistance and enables prevention of dislocation and detachment of an impact-resistant pad.

According to an aspect of the present invention, a glove includes: a stretchable glove main body made of fiber; a coating layer comprising a synthetic resin or rubber as a principal component, the coating layer being laminated to an external face of the glove main body at least in a finger portion and a palm portion; and one or a plurality of impact-resistant pad comprising a synthetic resin as a principal component, the impact-resistant pad being provided to at least a part of an external face side of the coating layer on a back hand side of the glove main body, in which the impact-resistant pad is sewn onto the glove main body.

In the glove, since the impact-resistant pad is provided to the external face side of the coating layer by sewing onto the glove main body, impact absorption can be improved by virtue of a space between the impact-resistant pad and the coating layer, while maintaining a force for fixing the impact-resistant pad to the glove main body. In addition, by sewing the impact-resistant pad onto the glove main body through the coating layer, movement of a sewing thread caused by spaces between stitches and in a weave pattern of the glove main body during stretching of the glove main body is inhibited, whereby dislocation of the impact-resistant pad is prevented. Furthermore, when a large impact is applied onto the impact-resistant pad, the coating layer acts as a cushion material, whereby tear and the like of the glove main body is also prevented. By virtue of the above, the glove is superior in impact resistance and allows prevention of dislocation and detachment of the impact-resistant pad. In addition, in the glove, since the impact-resistant pad is provided on a face of the coating layer, separation of the coating layer is less likely to occur.

The glove main body is preferably seamless. By thus overlaying the coating layer on the seamless glove main body, a defect in the coating layer or the like due to sewing of the glove main body can be prevented.

The impact-resistant pad is preferably provided to the finger portion. Since fingers, among all hand parts, are particularly likely to be subjected to an impact during labor, performance as a work glove can be improved by providing the finger portion with the impact-resistant pad.

An internal face of the impact-resistant pad and an external face of the coating layer are preferably smooth. By virtue of the internal face of the impact-resistant pad and the external face of the coating layer each being smooth, an area is provided where these members are likely to be in close contact with each other with no gap therebetween, whereby water proofing properties and oil resistance can be improved.

The impact-resistant pad preferably further contains a plasticizer and a pigment, and the content of the plasticizer with respect to the synthetic resin, which is the principal component, is preferably no less than 70% by mass. The plasticizer and the pigment in predetermined amounts being contained in the impact-resistant pad facilitate formation of the impact-resistant pad and improve bending flexibility of the impact-resistant pad. Furthermore, visibility, and eventually safety, of the impact-resistant pad can be improved by coloring.

The impact-resistant pad is preferably provided with a base layer that is overlaid on the coating layer, and a protruding part that is provided to protrude from an external face of the base layer. The impact-resistant pad thus provided with the base layer and the protruding part can facilitate formation and sewing, and improve impact resistance and the like.

The protruding part of the impact-resistant pad, which is provided to the back hand side of the finger portion, among the impact-resistant pads is preferably composed of a plurality of blocks partitioned by a plurality of troughs along a longitudinal direction of a finger portion and a large number of troughs perpendicular to the longitudinal direction. Thus configuring the protruding part can further increase impact resistance, while improving design.

The term "principal component" as referred to means a component of which content is the highest, for example a component of which content is no less than 50% by mass.

EFFECTS OF THE INVENTION

As explained in the foregoing, the present invention can provide a glove that is superior in impact resistance and allows prevention of dislocation and detachment of an impact-resistant pad.

DESCRIPTION OF THE PREFERRED EMBODIMENTS

Embodiments of the present invention are described in detail hereafter with reference to the Drawings as necessary.

First Embodiment

Figure 1:
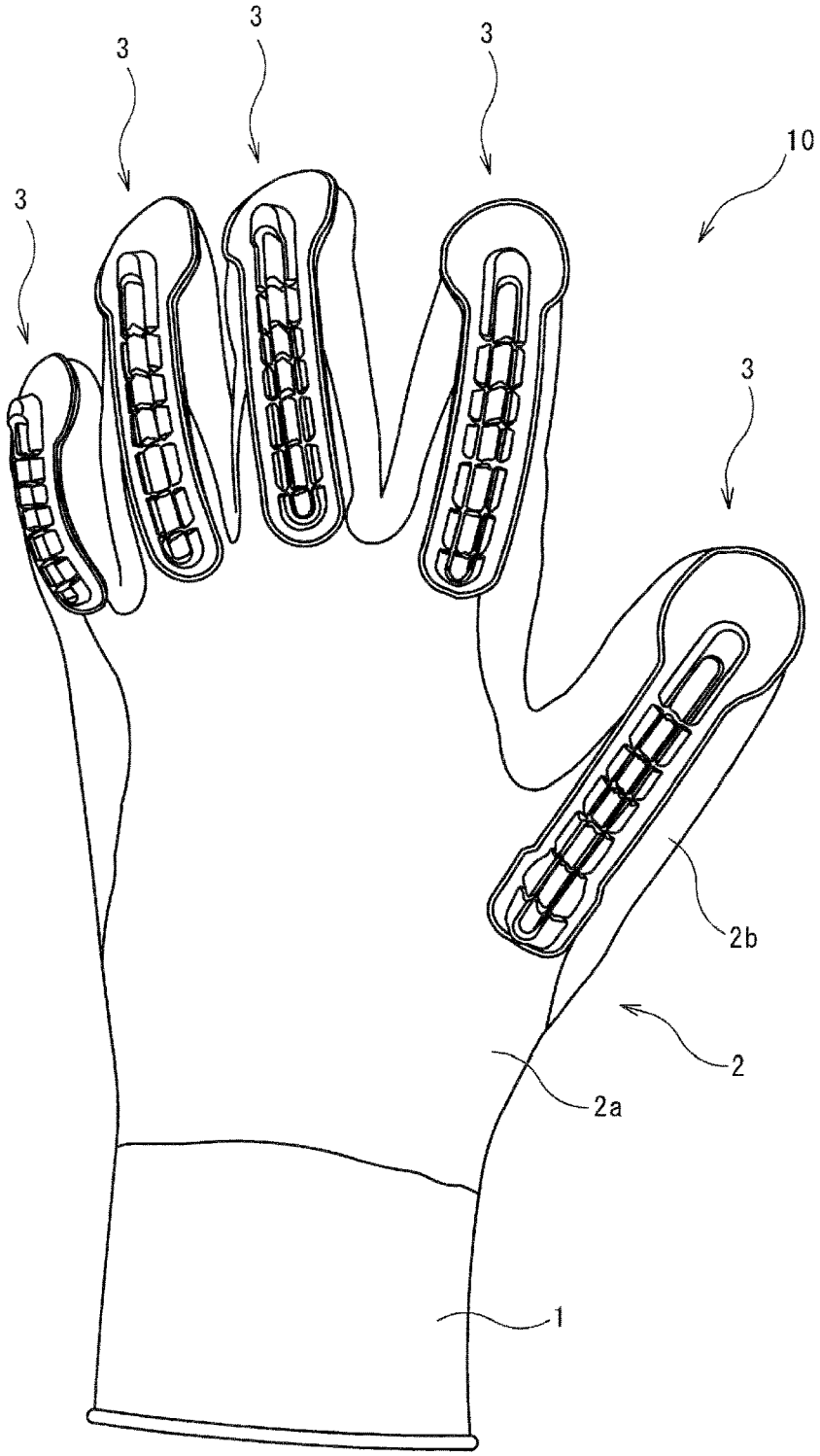
FIG. 1 is a schematic view taken from a back hand side of a glove according to an embodiment of the present invention.
Figure 5:
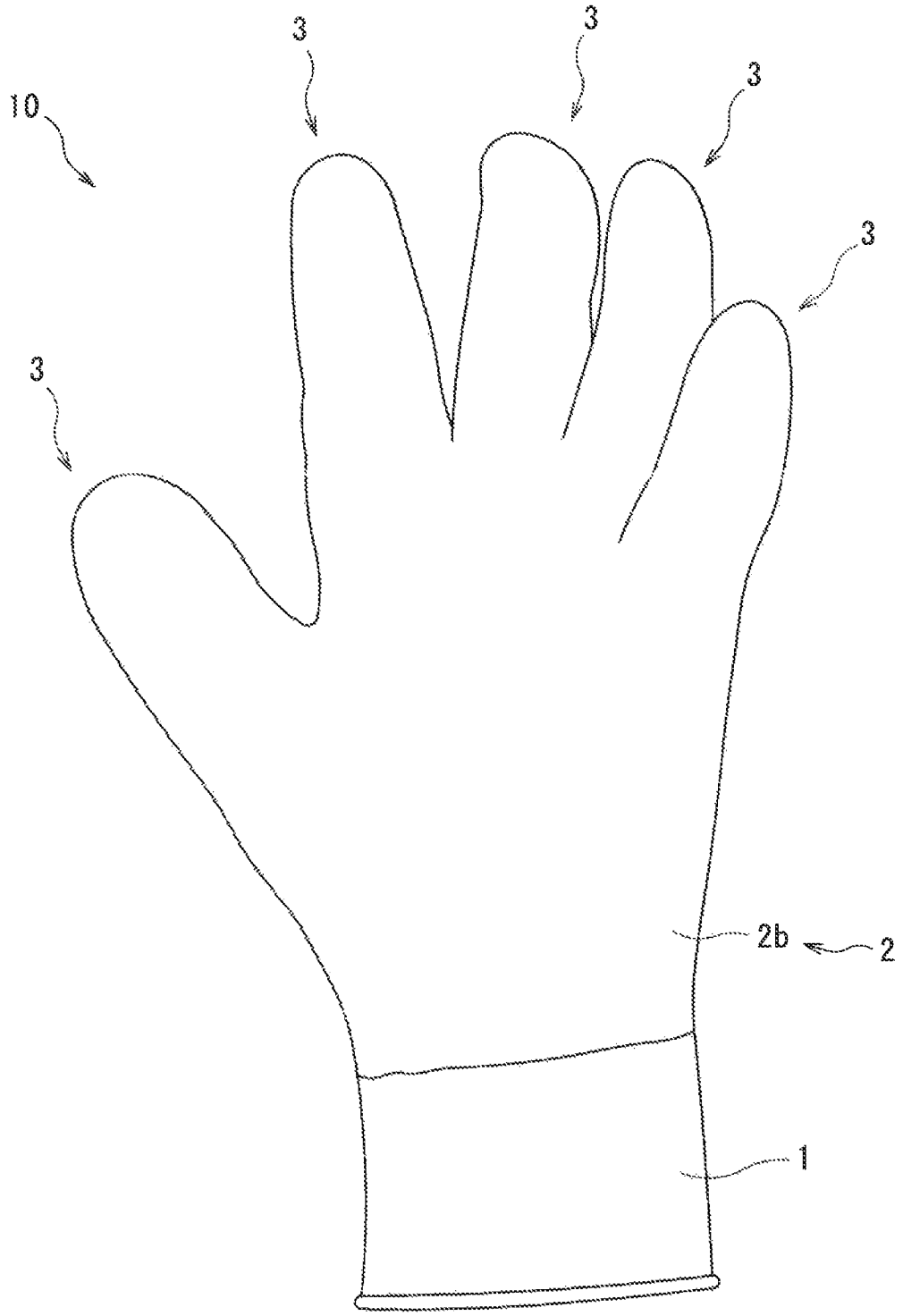
FIG. 5 is a schematic view taken from the palm side of the glove illustrated in FIG. 1.

A glove 10 illustrated in FIGS. 1 and 5 includes: a stretchable glove main body 1 made of fiber; a coating layer 2 laminated to an external face of the glove main body 1 at least in a finger portion and a palm portion; and a plurality of impact-resistant pads 3 provided to the finger portion on an external face side of the coating layer 2 on a back hand side of the glove main body 1.

Glove Main Body

The glove main body 1 is obtained by knitting or weaving a yarn made of fiber, and is stretchable. The globe main body 1 is preferably knitted seamlessly. In a case of forming a glove shape from a coated fabric with an impact-resistant pad provided thereon beforehand, sewing is necessary for forming the glove shape. In other words, when the glove main body 1 is not seamless, the glove main body is formed by sewing two or more pieces of fabric together. For example, in order to facilitate attachment of an impact-resistant pad, it is contemplated to sew the impact-resistant pad onto an unprocessed fabric or to a resin-coated fabric and then sew the fabric together into a glove shape. In this case, a seam is generally formed on a lateral face or on a palm side of the lateral face of the glove, and the seam may lead to formation of a hole on the coated fabric on the lateral face, a palm face, etc. which are likely to be subjected to hydraulic pressure during use, whereby water proofing property may be impaired. Whereas, by forming the glove main body 1 seamlessly and overlaying the coating layer 2 on the glove main body 1, a defect in the coating layer due to sewing for obtaining the glove shape can be prevented.

The glove main body 1 includes; a main body portion formed in a pouch-like shape to cover a dorsal side and a palm of a user's hand; a finger portion extending from the main body portion to cover user's fingers; and a cylindrical cuff portion extending from the main body portion in an opposite direction from the finger portion to cover a user's wrist. The main body portion includes a palm portion and a dorsal portion. The finger portion includes a first finger portion, a second finger portion, a third finger portion, a fourth finger portion, and a fifth finger portion that cover a user's first finger (thumb), second finger (index finger), third finger (middle finger), fourth finger (ring finger), and fifth finger (pinky finger) respectively. The first to fifth finger portions are each formed in a cylindrical shape with a closed, fingertip end. In addition, the cuff portion has an opening through which a user's hand can be inserted.

Examples of the fiber composing the glove main body 1 include: natural fibers such as cotton and linen; synthetic fibers such as a polyamide fiber, a polyester fiber, a polypropylene fiber, a rayon fiber, an acrylic fiber, an aramid fiber, a high-strength polyethylene fiber, a polyurethane fiber, and a super high-strength polyethylene fiber; metallic fibers such as stainless steel; inorganic fibers such as a glass fiber; a conductive fiber; and the like. These fibers may be used alone or as a mixture of two or more. Examples of fibers used as a mixture of two include a composite yarn obtained by covering a stainless fiber with nylon or the like. The abovementioned fiber is selected according to a required function such as heat-retaining properties, thermal insulation properties, cut resistance, moisture-retaining properties, cushioning properties, and the like. For example, for obtaining cut resistance: a metallic fiber such as a stainless fiber; an ultra high molecular weight polyethylene fiber; an aramid fiber; a glass fiber; and the like can be selected. In addition, a yarn made of the aforementioned fiber is not particularly limited, and a spun yarn, a crimped filament yarn, a fancy yarn such as a loop yarn and a chenille yarn, a straight filament yarn, and the like may be used.

The lower limit of an average thickness of the glove main body 1 is preferably 0.1 mm, and more preferably 0.2 mm. On the other hand, the upper limit of the average thickness of the glove main body 1 is preferably 4 mm, and more preferably 3 mm. In the case of the average thickness of the glove main body 1 being less than the lower limit, durability of the glove 10 may be decreased. To the contrary, in the case of the average thickness of the glove main body 1 being greater than the upper limit, flexibility of the glove 10 is decreased due to the increased thickness, whereby workability during wearing may be deteriorated. Here, the term "average thickness of the glove main body 1" as referred to means an average of values measured at 10 positions at intervals of 2 mm in a finger region of the glove for a distance between an inner face and an exterior face of a fiber layer, by: making a slit of 20 mm at an angle of approximately 45° with respect to a longitudinal direction of the finger portion; and observing a cross-section of the slit by using a digital microscope (e.g., VHX-900 available from Keyence Corporation).

Coating Layer

The coating layer 2 is laminated to a region on the external face of the glove main body 1 including the finger portion and the palm portion. Specifically, the coating layer 2 includes: a first coating layer 2*a* that covers the palm portion, an dorsal portion and the finger portion of the external face of the glove main body 1; and a second coating layer 2*b* that covers an external face of the first coating layer 2*a* on the palm portion and the finger portion. It is to be noted that the coating layer 2 is not limited to the two-layer structure and may also be in a single layer structure or a multilayer structure with three or more layers. In addition, the coating layer 2 is only required to cover at least the finger portion and the palm portion, and may not be formed in the dorsal portion. Furthermore, the term "laminated to the finger portion" as referred to is a concept not limited to being laminated to the entire finger portion, but includes being laminated to a part of the finger portion (substantially the entire finger portion) except for a part (e.g. vicinity of a connecting region with the dorsal portion and vicinity of a base of finger portion).

The coating layer 2 comprises a synthetic resin or rubber as a principal component. Examples of the synthetic resin include polyvinyl chloride, polyurethane, polyvinylidene chloride, polyvinyl alcohol, chlorinated polyethylene, an ethylene-vinyl alcohol copolymer, a vinyl chloride-vinyl acetate copolymer, and a mixture thereof. Of these, polyvinyl chloride and polyurethane are preferred and polyvinyl chloride is particularly preferred in light of processability. Examples of the rubber include a natural rubber, an isoprene rubber, an acrylic rubber, a chloroprene rubber, a butyl rubber, a butadiene rubber, a fluorine rubber, a styrene-butadiene copolymer, an acrylonitrile-butadiene rubber, a chlorosulfonated polyethylene, an epichlorohydrin rubber, a urethane rubber, an ethylene-propylene rubber, a silicone rubber, and a mixture thereof. Of these, a natural rubber, an isoprene rubber, a chloroprene rubber, a butadiene rubber, a styrene-butadiene copolymer and an acrylonitrile-butadiene rubber are preferred, and a natural rubber and an acrylonitrile-butadiene rubber are particularly preferred in light of cost efficiency, processability, elasticity, durability, weather resistance, etc. Furthermore, an acrylonitrile-butadiene rubber is particularly preferred in light of oil resistance.

To the coating layer 2, for example a softening agent, an antimicrobial, a crosslinking agent, a vulcanization accelerator, an antioxidant, a thickening agent, a plasticizer, a pigment, a frothing agent, a foam stabilizer and the like may be added.

Materials for the first coating layer 2*a* and for the second coating layer 2*b* may be identical; however, by using different materials for these layers, characteristics of the glove 10 can be partially varied. Furthermore, by employing different colors for the first coating layer 2*a* and for the second coating layer 2*b*, design can be improved.

The lower limit of an average thickness of the first coating layer 2*a* is preferably 0.2 mm, and more preferably 0.3 mm. On the other hand, the upper limit of the average thickness of the first coating layer 2*a* is preferably 2 mm, and more preferably 1.5 mm. The lower limit of an average thickness of the second coating layer 2*b* is preferably 0.1 mm, and more preferably 0.2 mm. On the other hand, the upper limit of the average thickness of the second coating layer 2*b* is preferably 2 mm, and more preferably 1.5 mm. In the case of the average thickness of the first coating layer 2*a* or of the second coating layer 2*b* being less than the lower limit, strength of the coating layer 2 may be insufficient. To the contrary, in the case of the average thickness of the first coating layer 2*a* or of the second coating layer 2*b* being greater than the upper limit, flexibility of the glove 10 may be insufficient. Here, the term "average thickness of the coating layer" as referred to means an average of values measured at 10 positions at intervals of 2 mm in a finger region on the back hand side of the glove for a distance between an inner face and an exterior face of each of the coating layers, by: making a slit of 20 mm at an angle of approximately 45° with respect to a longitudinal direction of a finger portion; and observing a cross-section of the slit by using a digital microscope (e.g., VHX-900 available from Keyence Corporation).

It is preferred that the external face of the coating layer 2 has a smooth area at least in a region including a position at which the impact-resistant pad 3 described later is provided. Specifically, the upper limit of an arithmetic average roughness Ra of the external face of the coating layer 2 is preferably 0.5 μm, and more preferably 0.3 μm. On the other hand, the lower limit of the arithmetic average roughness Ra of the external face of the coating layer 2 is for example 0.01 μm. In the case of the arithmetic average roughness Ra being greater than the upper limit, adhesiveness between the coating layer 2 and the impact-resistant pad 3 may be decreased, whereby water proofing properties and oil resistance may be insufficient. To the contrary, in the case of the arithmetic average roughness Ra being less than the lower limit, production cost of the glove 10 may be excessive. It is to be noted that the term "arithmetic average roughness Ra" as referred to means a value obtained by: obtaining a roughness curve by using an interference surface profilometer (e.g. Talysurf CCI Lite available from Taylor Hobson, Ltd. with 20× lens) with a cut-off of 0.08 mm; from the roughness curve, extracting a portion in a reference length (0.83 mm) in a direction of an average line thereof; and summing and averaging absolute values of deviations from the average line to the measured curve in the extracted portion.

In addition, it is preferred that the external face of the coating layer 2 has tack properties at least in a region including the position at which the impact-resistant pad 3 described later is provided. The tack properties facilitate close contact between the coating layer 2 and the impact-resistant pad 3 with no gap therebetween, whereby water proofing property and oil resistance can be improved. It is to be noted that the term "tack properties" as referred to means properties of providing adhesion (tackiness) when two layers are laminated such that surfaces thereof are brought into contact with each other.

Impact-Resistant Pad

A plurality of impact-resistant pads 3 are provided directly (without an intervention of other layer) to the finger portion on the external face of the coating layer 2 on the back hand side of the glove main body 1. Specifically, one impact-resistant pad 3 is provided to each of the individual finger portions (first finger portion, second finger portion, third finger portion, fourth finger portion, and fifth finger portion).

Figure 2:
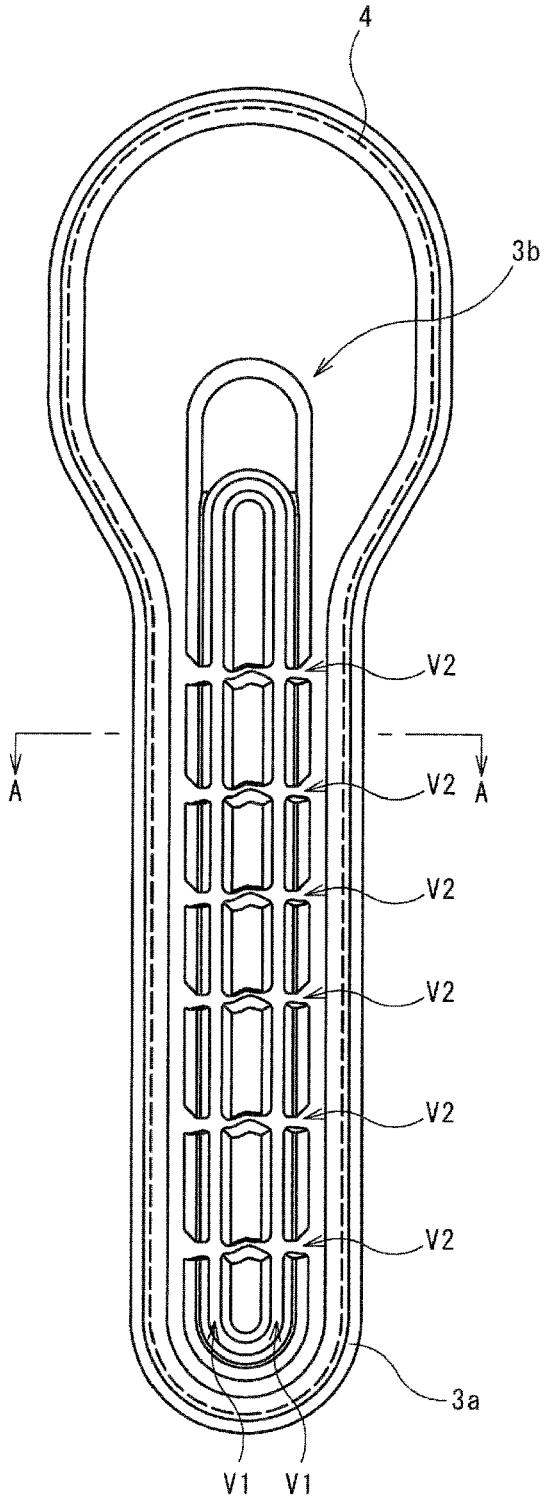
FIG. 2 is an enlarged schematic view of an impact-resistant pad provided to a finger portion of the glove illustrated in FIG. 1.
Figure 3:
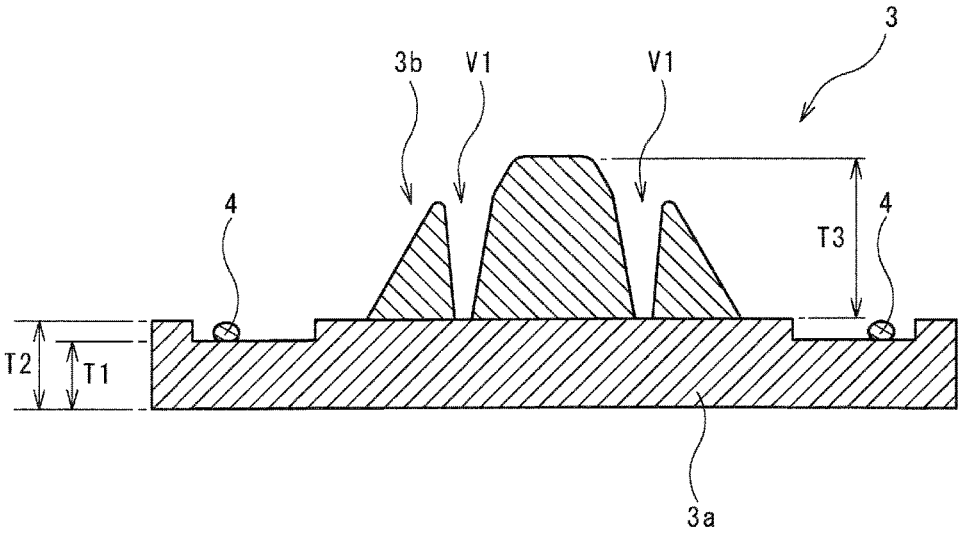
FIG. 3 is a schematic cross sectional view taken along a line A-A of the impact-resistant pad illustrated in FIG. 2.

As illustrated in FIGS. 2 and 3, the impact-resistant pad 3 is provided with: a base layer 3*a* that is overlaid on the coating layer 2; and a protruding part 3*b* that is provided to protrude from an external face of the base layer 3*a*.

A position at which the impact-resistant pad 3 is provided may be appropriately determined according to an intended use of the glove 10. In other words, the impact-resistant pad 3 may be: provided to an entirety of each finger portion along the longitudinal direction thereof as illustrated in FIG. 1; provided so as to cover only a first joint portion, a second joint portion, or a combination thereof in each finger portion; or provided so as to cover only an area between a fingertip end and the first joint portion, an area between the first joint portion and the second joint portion, an area between the second joint portion and the third joint portion, or a combination thereof. In the case in which the impact-resistant pad 3 covers a plurality of spaced-apart portions, the impact-resistant pad 3 is composed of a plurality of blocks segmented to correspond to the portions to be covered (segmented base layer 3*a* and protruding parts 3*b*).

The impact-resistant pad 3 comprises a synthetic resin as a principal component. Examples of the synthetic resin include polyvinyl chloride, polyurethane, polyvinylidene chloride, polyvinyl alcohol, chlorinated polyethylene, an ethylene-vinyl acetate copolymer, a vinyl chloride-vinyl acetate copolymer, and a mixture thereof. Of these, polyvinyl chloride and polyurethane are preferred and polyvinyl chloride is particularly preferred in light of processability.

In addition, to the impact-resistant pad 3, a softening agent, an antimicrobial agent, an antioxidant, a thickening agent, a plasticizer, a pigment and the like may be added. In particular, the impact-resistant pad 3 preferably contains a plasticizer in light of improvement of formability. As the plasticizer, for example, a non-phthalic acid plasticizer is used. Furthermore, the impact-resistant pad 3 preferably contains a pigment in light of improvement of visibility.

The lower limit of the plasticizer content is preferably 70% by mass, more preferably 80% by mass, and further more preferably 100% by mass with respect to the synthetic resin as the principal component. On the other hand, the upper limit of the plasticizer content is, for example, 250% by mass. In the case of the plasticizer content being less than the lower limit, an effect of improving formability and bending flexibility may be insufficient. To the contrary, in the case of the plasticizer content being greater than the upper limit, hardness of the impact-resistant pad 3 may be insufficient and bleeding of the plasticizer may be caused.

It is to be noted that materials for the base layer 3*a* and for the protruding part 3*b* may be different; however, if at least the resin as the principal component is the same, integral molding is facilitated. In addition, by including different types of pigment in the base layer 3*a* and in the protruding part 3*b*, design of the glove 10 can be improved. Furthermore, when the hardness of the protruding part 3*b* is less than that of the base layer 3*a*, impact resistance can be improved while maintaining the strength of the impact-resistant pad 3.

Here, a contact angle of the external face of the coating layer 2 and/or a contact angle of the external face of the impact-resistant pad 3 are preferably no less than 70°. In the case of the contact angle of the external face of the coating layer 2 and/or of the external face of the impact-resistant pad 3 being no less than 70°, water repellency of these faces is improved. Accordingly, water is prevented from entering through sewing holes formed upon sewing the impact-resistant pad 3 onto the glove main body 1, whereby water proofing properties of the glove 10 can be improved. It is to be noted that the term "contact angle" as referred to means a static contact angle measured conforming to JIS-R-3257 (1999).

Base Layer

The base layer 3*a* is strip-shaped, a longitudinal direction of which corresponds to the longitudinal direction of the finger portion of the glove 10. A planar shape of the base layer 3*a* has rounded corners and a fingertip end side expanded in width and longitudinal directions to have a circular arc shape. The expanded part is for covering user's entire nail. In addition, the base layer 3*a* is sewn onto the coating layer 2 and onto the glove main body 1 with a sewing thread 4 at a position along, and offset from, an edge of the base layer 3*a*. It is to be noted that a groove for sewing is formed on the base layer 3*a* at a position at which the sewing thread 4 is to be sewn. In addition, an amount of offset of the sewing position from the edge of the base layer 3*a* may be, for example, no less than 0.5 mm and no greater than 3 mm.

The base layer 3*a* is sewn only on the edge (outer periphery) thereof and has a region not being fixed to the coating layer 2 in a central part thereof. In this region, a space is formed between the base layer 3*a* (impact-resistant pad 3) and the coating layer 2, whereby the impact resistance is improved.

It is to be noted that the base layer 3*a* (impact-resistant pad 3) is not required to be sewn onto the glove main body 1 on the entire edge (entire periphery) as illustrated in FIG. 2, and may have a region not being sewn on the outer periphery. Alternatively, an internal region other than the edge may also be sewn onto the glove main body 1. Furthermore, the number of sewing line(s) on a single base layer 3*a* is not limited to 1 as illustrated in FIG. 2, and a plurality of sewing lines may be formed on the single base layer 3*a*.

The lower limit of an average thickness T1 of the sewn part of the base layer 3*a* is preferably 0.3 mm, and more preferably 0.5 mm. On the other hand, the upper limit of the average thickness T1 of the sewn part of the base layer 3*a* is preferably 4 mm, and more preferably 3 mm. In the case of the average thickness T1 of the sewn part of the base layer 3*a* being less than the lower limit, strength of the base layer 3*a* may be insufficient, whereby breakage and detachment of the base layer 3*a* are likely to occur. To the contrary, in the case of the average thickness T1 of the sewn part of the base layer 3*a* being greater than the upper limit, the impact-resistant pad 3 may become unnecessarily large. Here, the average thickness of the sewn part of the base layer is an average of values measured at 10 positions for a distance between a bottom surface and an upper surface of the groove for sewing, by observing a cross-section thereof by using a digital microscope (e.g., VHX-900 available from Keyence Corporation).

The lower limit of the hardness of the base layer 3*a* is preferably A30, and more preferably A40. On the other hand, the upper limit of the hardness of the base layer 3*a* is preferably A80, and more preferably A70. In the case of the hardness of the base layer 3*a* being less than the lower limit, the impact resistance may be insufficient. To the contrary, in the case of the hardness of the base layer 3*a* being greater than the upper limit, flexibility of the glove 10 may be reduced. It is to be noted that the term "hardness" as referred to means hardness measured by using a Type A durometer, conforming to JIS-K6253-3 (2012) and to ISO7619 (2010).

An internal face (a face directed to the glove main body 1) of the base layer 3*a* is preferably smooth. Specifically, the upper limit of the arithmetic average roughness Ra of the internal face of the base layer 3*a* is preferably 0.15 μm, and more preferably 0.1 μm. On the other hand, the lower limit of the arithmetic average roughness Ra of the internal face of the base layer 3*a* is for example 0.005 μm. In the case of the arithmetic average roughness Ra being greater than the upper limit, adhesiveness between the coating layer 2 and the impact-resistant pad 3 may be decreased, whereby water proofing properties and oil resistance may be insufficient. To the contrary, in the case of the arithmetic average roughness Ra being less than the lower limit, production cost of the glove 10 may be excessive.

In addition, the internal face of the base layer 3*a* preferably has tack properties. The tack properties provide an area where the coating layer 2 and the impact-resistant pad 3 are likely to be in close contact with each other with no gap therebetween, whereby water proofing properties and oil resistance can be improved.

Protruding Part

The protruding part 3*b* is provided to protrude from the external face of the base layer 3*a* (opposite side to the glove main body 1). In addition, the protruding part 3*b* is composed of a plurality of blocks partitioned by: a plurality of V-shaped or U-shaped first troughs V1 along the longitudinal direction of a finger portion; and a large number of V-shaped or U-shaped second troughs V2 perpendicular to the longitudinal direction. Specifically, the protruding part 3*b* has a plurality of blocks that are rectangular in a planar view and partitioned by two first troughs V1 and a plurality of second troughs V2 that intersect perpendicularly with the two first troughs V1 in a planar view. In addition, the protruding part 3*b* has, on a distal side and a proximal side (palm side) thereof, blocks that are each formed in a U-shape in a planar view, protrude outward in the longitudinal direction of the finger portion, and are arranged to oppose each other across other plurality of blocks. The blocks other than these blocks that are rectangular in a planar view are arranged in three rows at a regular interval along the longitudinal direction.

Regarding thicknesses T2 of a part of the base layer 3*a* composing bottom portions of the first trough V1 and of the second trough V2, it is preferred that the thickness T2 of the part composing the bottom portion of the first trough V1 is greater than the thickness T2 of the part composing the bottom portion of the second trough V2. According to such a configuration, bending flexibility of the impact-resistant pad 3 can be improved.

Among the blocks constituting the protruding part 3*b*, blocks in a central row between two first troughs V1 each have a greater thickness (protruding amount) than blocks in both side rows (right and left rows). In addition, a cross section, which is perpendicular to the longitudinal direction of the finger portion, of the block in the central row is trapezoidal, and such a cross section of the block in the both side rows is triangular.

A length in the longitudinal direction of the protruding part 3*b* (a distance between a distal end of the most distal block and a proximal end of the most proximal block) is, for example, no less than 50% and no greater than 90% of a length of the finger portion. In addition, a length in the width direction of the protruding part 3*b* (a distance between a left end of a block in the left row and a right end of a block in the right row) is, for example, no less than 5% and no greater than 50% of a width of the finger portion. Furthermore, a length in the longitudinal direction of the block that is rectangular in a planar view may be, for example, no less than 1 mm and no greater than 10 mm, and a length thereof in a transverse direction (width direction) may be, for example, no less than 0.1 mm and no greater than 3 mm.

The lower limit of a total thickness (T2+T3) of: the thickness T2 of the part forming the bottom portion of the first trough V1 or of the second trough V2; and the maximum thickness T3 (maximum protruding amount) of the protruding part 3*b*, is preferably 1 mm and more preferably 3 mm. On the other hand, the upper limit of the total thickness (T2+T3) is preferably 9 mm, and more preferably 7 mm. In the case of the total thickness (T2+T3) being less than the lower limit, the impact resistance may be insufficient. To the contrary, in the case of the total thickness (T2+T3) being greater than the upper limit, the impact-resistant pad 3 may become unnecessarily large. Here, the maximum thickness of the protruding part is an average of values measured at 10 positions for a distance between the most projecting part of the protruding part and an upper face of the base layer, by observing a cross-section of the protruding part by using a digital microscope (e.g., VHX-900 available from Keyence Corporation).

The lower limit of the hardness of the protruding part 3*b* is preferably A30, and more preferably A40. On the other hand, the upper limit of the hardness of the protruding part 3*b* is preferably A70, and more preferably A60. In the case of the hardness of the protruding part 3*b* being less than the lower limit, the impact resistance may be insufficient. To the contrary, in the case of the hardness of the protruding part 3*b* being greater than the upper limit, impact absorbing properties may be reduced. It is to be noted that the hardness of the protruding part 3*b* may be the same as the hardness of the base layer 3*a*.

Sewing Thread

The sewing thread 4 is used for sewing the base layer 3*a* of the impact-resistant pad 3 to the glove main body 1. In other words, the sewing thread 4 runs through the impact-resistant pad 3 (base layer 3*a*), the coating layer 2, and the glove main body 1. A thickness of the sewing thread 4 may be, for example, no less than 150 dtex and no greater than 800 dtex. Examples of a material for the sewing thread 4 include polyesters and the like. In addition, the sewing thread has preferably been subjected to a water repellent treatment or an oil repellent treatment.

Production Method of Glove

The glove 10 can be obtained by a production method comprising steps of, for example: laminating the coating layer 2 onto the glove main body 1; forming the impact-resistant pad 3; and providing the impact-resistant pad 3 to at least a part of an external face side of the coating layer 2 on the back hand side of the glove main body 1 by sewing to the glove main body 1.

Laminating Step

In the laminating step, the glove main body 1 is fitted on a hand mold, and a composition for forming the coating layer is applied onto the external face of the glove main body 1 and dried, whereby the coating layer 2 is laminated on the glove main body 1. As a process for applying the composition, a well-known process may be employed and examples of which include a process of dipping the glove main body 1 in the composition. It is to be noted that in the case of the coating layer 2 being multilayered as illustrated in FIG. 1, application and drying are performed a plurality of times with different compositions.

Impact-Resistant Pad Forming Step

In the impact-resistant pad forming step, the impact-resistant pad 3 is formed from a composition containing a synthetic resin. Specific examples of a process for the forming include a process of pouring the composition into a mold and curing. It is to be noted that in the case of the impact-resistant pad 3 having a plurality of parts (the base layer 3*a* and the protruding part 3*b*) as illustrated in FIG. 1, these parts may be either integrally formed or separately formed and then joined.

Providing Step

In the providing step, the impact-resistant pad 3 is sewn onto the glove main body 1 through the coating layer 2.

Advantages

In the glove 10, since the impact-resistant pad 3 is provided to the external face of the coating layer 2 by sewing onto the glove main body 1, impact absorption can be improved by virtue of a space between the impact-resistant pad 3 and the coating layer 2, while maintaining a force for fixing the impact-resistant pad 3 to the glove main body 1. In addition, by sewing the impact-resistant pad 3 onto the glove main body 1 through the coating layer 2, movement of the sewing thread 4 caused by spaces between stitches and in a weave pattern of the glove main body 1 during stretching of the glove main body 1 is inhibited, whereby dislocation of the impact-resistant pad 3 is prevented. Furthermore, when a large impact is applied onto the impact-resistant pad 3, the coating layer 2 acts as a cushion material, whereby break and the like of the glove main body 1 is also prevented. By virtue of the above, the glove 10 is superior in impact resistance and allows prevention of dislocation and detachment of the impact-resistant pad 3.

In the case in which a coating layer is formed after attaching an impact-resistant pad to a glove main body, the coating layer on a surface of the impact-resistant pad is likely to separate; however, in the glove 10, since the impact-resistant pad 3 is provided on a surface of the coating layer 2, separation of the coating layer 2 is less likely to occur.

Furthermore, in the glove 10, by sewing the impact-resistant pad 3 to the glove while applying a slight tension to the coating layer 2, a glove can be obtained with the finger portion curved in a direction of curvature of the fingers. As a result, fit and bendability of the glove are improved, whereby labor efficiency is improved.

Second Embodiment

Figure 4:
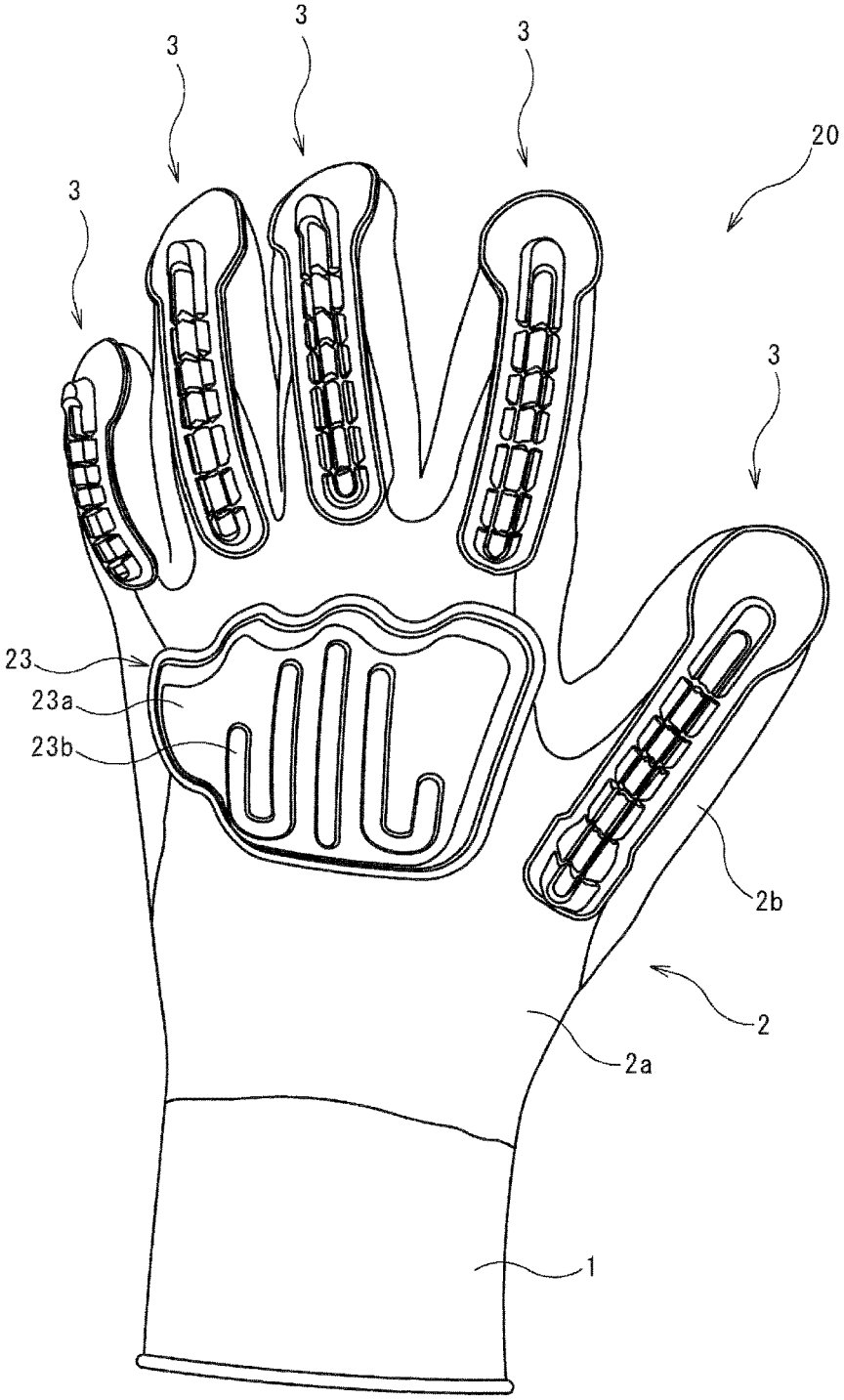
FIG. 4 is a schematic view taken from a back hand side of a glove according to an embodiment different from that of FIG. 1.

A glove 20 illustrated in FIG. 4 includes: a stretchable glove main body 1 made of fiber; a coating layer 2 laminated to an external face of the glove main body 1 at least in a finger portion and a palm portion; a plurality of finger impact-resistant pads 3 provided to the finger portion on an external face side of the coating layer 2 on a back hand side of the glove main body 1; and an dorsal impact-resistant pad 23 provided to an dorsal portion on the external face side of the coating layer 2. The glove main body 1, the coating layer 2, and the finger impact-resistant pad 3 of the glove 20 are identical to the glove main body 1, the coating layer 2, and the impact-resistant pad 3 of the glove 10 illustrated in FIG. 1, and are therefore referred to by the same reference numerals and description thereof is omitted.

Dorsal Impact-Resistant Pad

The dorsal impact-resistant pad 23 is provided to the dorsal portion on the external face side of the coating layer 2 on the back hand side of the glove main body 1, and sewn onto the glove main body 1 in a similar manner to the finger impact-resistant pad 3.

The dorsal impact-resistant pad 23 is provided with: a base layer 23*a* that is overlaid on the coating layer 2; and a protruding part 23*b* that is provided to protrude from an external face of the base layer 23*a*.

The dorsal impact-resistant pad 23 comprises a synthetic resin as a principal component. The synthetic resin may be the same as the synthetic resin used for the finger impact-resistant pad 3. Similarly, additives which may be added to the dorsal impact-resistant pad 23 may be the same as those exemplified for the finger impact-resistant pad 3.

Base Layer

The base layer 23*a* is plate-like and is provided directly to the coating layer 2 so as to cover the third joint of each finger and a part of the dorsal portion. The base layer 23*a* is sewn onto the coating layer 2 and onto the glove main body 1 with a sewing thread (not illustrated) at a position along, and offset from, an edge of the base layer 23*a*. It is to be noted that a groove for sewing is formed on the base layer 23*a* at a position at which the sewing thread is to be sewn, and the base layer 23*a* is formed in a convex shape such that an average thickness gradually increases from the groove to an inner side. It is to be noted that an amount of offset of the sewing position from the edge of the base layer 23*a* may be the same as in the finger impact-resistant pad 3.

The lower limit of the average thickness of the base layer 23*a* is preferably 1 mm, and more preferably 3 mm. On the other hand, the upper limit of the average thickness of the base layer 23*a* is preferably 7 mm, and more preferably 6 mm. In the case of the average thickness of the base layer 23*a* being less than the lower limit, strength of the base layer 23*a* may be insufficient. To the contrary, in the case of the average thickness of the base layer 23*a* being greater than the upper limit, the dorsal impact-resistant pad 23 may become unnecessarily large.

The lower limit of the hardness of the base layer 23*a* is preferably A40, and more preferably A50. On the other hand, the upper limit of the hardness of the base layer 23*a* is preferably A80, and more preferably A70. In the case of the hardness of the base layer 23*a* being less than the lower limit, the impact resistance may be insufficient. To the contrary, in the case of the hardness of the base layer 23*a* being greater than the upper limit, flexibility of the glove 20 may be reduced.

An internal face of the base layer 23*a* is preferably smooth. The arithmetic average roughness Ra of the internal face of the base layer 23*a* may be the same as that of the base layer of the finger impact-resistant pad 3. In addition, the internal face of the base layer 23*a* preferably has tack properties.

One or a plurality of slits may be formed on the base layer 23*a* in the longitudinal direction of the finger portion. The slit can provide the dorsal impact-resistant pad 23 with flexibility.

Protruding Part

The protruding part 23*b* is provided to protrude from the external face of the base layer 23*a*.

The lower limit of a total thickness of an average thickness of the base layer 23*a* and the maximum thickness (maximum protruding amount) of the protruding part 23*b* is preferably 2 mm and more preferably 3 mm. On the other hand, the upper limit of the total thickness is preferably 10 mm, and more preferably 8 mm. In the case of the total thickness being less than the lower limit, the impact resistance may be insufficient. To the contrary, in the case of the total thickness being greater than the upper limit, the dorsal impact-resistant pad 23 may become unnecessarily large.

The lower limit of the hardness of the protruding part 23*b* is preferably A30, and more preferably A40. On the other hand, the upper limit of the hardness of the protruding part 23*b* is preferably A70, and more preferably A60. In the case of the hardness of the protruding part 23*b* being less than the lower limit, the strength may be insufficient. To the contrary, in the case of the hardness of the protruding part 23*b* being greater than the upper limit, the impact absorbing properties may be reduced. It is to be noted that the hardness of the protruding part 23*b* may be the same as the hardness of the base layer 23*a*.

Advantages

The glove 20 is provided with the dorsal impact-resistant pad 23 in addition to the finger impact-resistant pad 3, whereby a user's hand can be protected more reliably.

Other Embodiments

The present invention is not limited to the above-described embodiments, and can also be carried out in modes modified and improved in various ways.

The above-described embodiments are configured such that the impact-resistant pad is provided at least to the finger portion; however, the glove of the present invention is only required to have the impact-resistant pad provided at least partially to the external face side of the coating layer on the back hand side of the glove main body, and therefore a mode with the finger portion not having the impact-resistant pad provided thereto also falls within the intended scope of the present invention. In addition, in the case in which the impact-resistant pad is provided to the finger portion, not all of the individual finger portions are required to have the impact-resistant pad being provided thereto. Furthermore, a plurality of impact-resistant pads may be provided to the dorsal portion. Moreover, the glove may further be provided with an impact-resistant pad that is provided to a position different from the finger impact-resistant pad and the dorsal impact-resistant pad.

Alternatively, the impact-resistant pad is only required to be provided at least partially to the external face side of the coating layer, and a part thereof may be provided to the glove main body directly. In other words, the impact-resistant pad can partially be provided to a region free of the coating layer on the back hand side of the glove main body.

Furthermore, the shape of the impact-resistant pad of the present invention is not limited to the shape in the above-described embodiment and may be designed appropriately; and may not necessarily be provided with the base layer and the protruding part. In the case of the impact-resistant pad comprising the base layer and the protruding part, the protruding part is not required to be composed of the plurality of blocks.

Alternatively, the glove main body may be composed of an inner glove and an outer glove. The inner glove may be knitted from a yarn made of fiber; and the outer glove may comprise a base material that is knitted from a yarn made of fiber as described above and a coating layer that is overlaid on an external face of the base material, comprising a rubber or a resin as a principal component.

EXAMPLES

The present invention is described further in detail hereafter by way of Examples and Comparative Examples; however, the present invention is not limited to the following Examples.

Example 1

Glove Main Body

First, two woolly nylon two-fold yarns (number of filaments per yarn: 24, thickness: 77 dtex) were paralleled and knitted into a glove main body by using a 13 gauges glove knitting machine "N-SFG" manufactured by Shima Seiki Mfg., Ltd.

Coating Layer

Next, the glove main body was fitted onto a hand mold; heated to approximately 60° C.; dipped up to a wrist portion in a coagulating agent containing 1 part by mass of calcium nitrate dissolved in 100 parts by mass of methanol; and withdrawn. Subsequently, the glove main body with the coagulating agent adhered thereto was dipped in a compound 1 of a formula 1 shown in Table 1 up to the palm portion, the dorsal portion, and the finger portion. The glove main body thus dipped in the compound 1 was withdrawn, dried at 80° C. for 10 min, and then the palm portion and the finger portion were dipped in a compound 2 of a formula 2 shown in Table 1. It is to be noted that the compound 2 was prepared by mixing 30% of air into the formula 2 by an automatic mixer.

Thereafter, the glove main body was dried at 90° C. for 20 min and then at 130° C. for 45 min, thereby obtaining a glove with a coating layer formed on the external face of the glove main body, the coating layer comprising the rubber as a principal component.

TABLE 1

| Blended Substances | Formulation 1 (parts by mass) | Formulation 2 (parts by mass) |
|---|---|---|
| NBR latex | 100 | 100 |
| Sulfur | 2.0 | 2.0 |
| Zinc oxide | 1.0 | 1.0 |
| Vulcanization accelerator (Zinc dibutyldithiocarbamate) | 0.5 | 0.5 |
| Antioxidant (2,2-methylenebis(4-ethyl-6-tert-butylphenol)) | 0.5 | 0.5 |
| Heat-sensitizing agent (Aqueous solution of polyether-modified silicone) | 0.2 | 0.2 |
| Frothing agent (disodium N-alkylsulfosuccinic acid monoamide) | — | 3.0 |
| Foam stabilizer (Sodium laurylaminodipropionate) | — | 3.0 |

Impact-Resistant Pad

A compound obtained by mixing 100 parts by mass of polyvinyl chloride, 150 parts by mass of a non-phthalic acid plasticizer and a pigment was poured into a mold; and dried by heating at 250° C. for 1 min, thereby forming a protruding part of the impact-resistant pad. Next, a compound obtained by mixing 100 parts by mass of polyvinyl chloride, 150 parts by mass of a non-phthalic acid plasticizer and a pigment was poured onto the protruding part; and dried by heating at 180° C. for 15 min, thereby integrally forming the base layer and the protruding part of the impact-resistant pad. After cooling, the impact-resistant pad was released from the mold.

Sewing

The impact-resistant pad was arranged on the finger portion of the glove being obtained; and sewn onto the glove main body through the coating layer with a sewing thread (a polyester filament of 501 dtex) by using a small-cylinder-bed cylindrical double chain stitch machine ("SPX-211" available from Morimoto Mfg. Co., ltd).

Comparative Example 1

The same impact-resistant pad as that of Example 1 was fixed by using an acrylic adhesive, onto the same glove main body as that of Example 1 without the coating layer being formed.

Comparative Example 2

An impact-resistant pad was sewn onto the same glove main body as that of Example 1 without the coating layer being formed, by the same procedure as that of Example 1.

Evaluation 1

From the finger portion onto which the impact-resistant pad was sewn or adhered, a test piece (100 mm in length, and 30 mm in width) including the impact-resistant pad was cut off in the longitudinal direction; the test piece was stretched by 30% in the longitudinal direction 50 times; and dislocation and detachment of the impact-resistant pad were evaluated according to the following criteria. The results are shown in Table 2.

A: Neither dislocation nor detachment observed.

B: Dislocation observed, but no detachment observed.

C: Detachment observed.

TABLE 2

| | Dislocation and Detachment |
|---|---|
| Example 1 | A |
| Comparative Example 1 | C |
| Comparative Example 2 | B |

As can be seen in Table 2, the glove of Example 1 in which the impact-resistant pad was sewn onto the glove main body covered with the coating layer exhibited neither dislocation nor detachment of the impact-resistant pad. To the contrary, the glove of Comparative Example 1, in which the impact-resistant pad was provided with an adhesive, exhibited detachment of the impact-resistant pad; and also the glove of Comparative Example 2, in which the impact-resistant pad was sewn directly onto the glove main body with no intervention of the coating layer, exhibited dislocation of the impact-resistant pad. It is apparent from the results that by sewing the impact-resistant pad onto the glove main body through the coating layer, dislocation and detachment of the impact-resistant pad can be prevented.

Examples 2 and 3

A glove of Example 2 was produced under similar conditions to those of Example 1, except that a glove main body employed had a rougher (more uneven) external face than that of Example 1. A glove of Example 3 was produced under similar conditions to those of Example 1, except that the impact-resistant pad was formed by using a mold of which face corresponding to the internal face of the base layer was rougher than that of Example 1.

On the gloves of Examples 1 to 3, the arithmetic average roughness Ra of the external face of the coating layer and the arithmetic average roughness Ra of the internal face of the base layer were measured. The results are shown in Table 3.

Evaluation 2

Five testers wearing the gloves of Examples 1 to 3 performed tasks involving oil, and then the gloves were evaluated according to the following criteria. The results are shown in Table 3.

A: No oil permeation into the interior of glove.

B: Slight oil permeation into the interior of glove.

C: Obvious oil permeation into the interior of glove.

TABLE 3

| | Ra of External Face of Coating Layer (μm) | Ra of Internal Face of Base Layer (μm) | Oil Resistance |
|---|---|---|---|
| Example 1 | 0.1 | 0.01 | A |
| Example 2 | 0.6 | 0.01 | B |
| Example 3 | 0.1 | 0.2 | B |

It is apparent from the results shown in Table 3 that a lower arithmetic average roughness Ra of the external face of the coating layer and a lower arithmetic average roughness Ra of the internal face of the base layer, in other words a smoother external face of the coating layer and a smoother internal face of the base layer, provide superior oil resistance.

INDUSTRIAL APPLICABILITY

As explained in the foregoing, the glove of the present invention is superior in impact resistance and allows prevention of dislocation and detachment of an impact-resistant pad. Therefore, the glove can be suitably used as, for example, a glove used in labors such as civil engineering and construction works.

EXPLANATION OF REFERENCE NUMERALS

1 Glove main body
2 Coating layer
2*a* First coating layer
2*b* Second coating layer
3, 23 Impact-resistant pad
3*a*, 23*a* Base layer
3*b*, 23*b* Protruding part
4 Sewing thread
10, 20 Glove
V1, V2 Trough

What is claimed is:

1. A glove comprising: a stretchable glove main body made of fiber; a coating layer comprising a first synthetic resin or rubber as a principal coating component, the coating layer being laminated to an external face portion of the glove main body at least in a finger portion and a palm portion of the glove main body; and at least one impact-resistant pad comprising a second synthetic resin as a principal pad component, the at least one impact-resistant pad being arranged with at least a part of an external face side of the coating layer, wherein: the at least one impact-resistant pad is sewn onto the glove main body; the at least one impact-resistant pad comprises a base layer that is overlaid on the coating layer and a protruding part that is arranged on an external face of the base layer; the at least one impact-resistant pad is arranged on a dorsal side of the finger portion of the glove main body, the protruding part comprises a plurality of blocks that are rectangular in a planar view and partitioned by two first troughs along a longitudinal direction of the finger portion and a plurality of second troughs that intersect perpendicularly with the two first troughs in the planar view; the plurality of blocks that are rectangular in the planar view are arranged in three rows spaced at a regular interval along the longitudinal direction and include a central row of blocks, a left side row of blocks, and right side row of blocks; the central row of blocks is partitioned from the left side row of the blocks and the right side row of blocks by the two first troughs; the central row of blocks has a first thickness and a trapezoidal cross-section with a trapezoidal cross-section height defining the first thickness; the left side row of blocks and right side row of blocks each have a second thickness and a triangular cross-section with a triangular cross-section height defining the second thickness; wherein the trapezoidal cross-section and triangular cross-sections are defined perpendicularly to the longitudinal direction of the finger portion; wherein the first thickness of the central row of blocks is greater than the second thickness of each of the left side row of blocks and the right side row of blocks; wherein a space is provided between a region of the base layer and the coating layer; and wherein the external face side of the coating layer has a first arithmetic average roughness Ra that is no less than 0.01 μm and no greater than 0.5 μm and an internal face of the base layer has a second arithmetic average roughness Ra that is no less than 0.005 μm and no greater than 0.15 μm.

2. The glove according to claim 1, wherein the glove main body is seamless.

3. The glove according to claim 1, wherein the at least one impact-resistant pad further comprises a plasticizer and a pigment, and the second synthetic resin as a principal pad component has a first mass and the plasticizer has a second mass, the second mass being no less than 70% of the first mass.

* * * * *